US005906079A

United States Patent [19]

Brickner et al.

[11] Patent Number: 5,906,079

[45] Date of Patent: May 25, 1999

[54] PARTITION SYSTEM WITH ATTACHED MARKERBOARD

[75] Inventors: Kenneth D. Brickner; Steven F. Goodman, both of Wyoming; Daniel Grabowski, Grand Rapids; Matthew C. Roe, Ada, all of Mich.

[73] Assignee: Steelcase, Inc., Grand Rapids, Mich.

[21] Appl. No.: 09/006,577

[22] Filed: Jan. 14, 1998

[51] Int. Cl.[6] ..... E04H 3/00

[52] U.S. Cl. ..... 52/239; 52/238.1; 52/36.5; 52/36.6; 52/481.2

[58] Field of Search ..... 52/238.1, 239, 52/243, 36.4, 36.5, 36.6, 481.2

[56] References Cited

U.S. PATENT DOCUMENTS

| | | |
|---|---|---|
| 2,044,637 | 6/1936 | Ross . |
| 2,097,988 | 11/1937 | Ross et al. . |
| 2,947,093 | 8/1960 | Masters . |
| 3,034,184 | 5/1962 | Lindstrom . |
| 3,103,708 | 9/1963 | Pomeroy et al. . |
| 3,328,927 | 7/1967 | Kates . |
| 3,408,127 | 10/1968 | Vincens . |
| 3,557,499 | 1/1971 | Dickie et al. . |
| 3,700,385 | 10/1972 | Sherwood . |
| 3,721,050 | 3/1973 | Perina . |
| 3,722,163 | 3/1973 | Satkin et al. . |
| 3,733,755 | 5/1973 | Butler . |
| 3,744,199 | 7/1973 | Navarre . |
| 3,802,146 | 4/1974 | Tacke et al. . |
| 3,852,927 | 12/1974 | Birum, Jr. . |
| 3,883,196 | 5/1975 | Mohr et al. . |
| 3,906,695 | 9/1975 | Pilgrim et al. . |
| 3,948,011 | 4/1976 | Price et al. . |

(List continued on next page.)

FOREIGN PATENT DOCUMENTS

| | | |
|---|---|---|
| 123616 | 3/1988 | Canada . |
| 7802908 | 9/1979 | Netherlands . |

OTHER PUBLICATIONS

Packard Officenter 2000, p. 8 (publication date unknown).
The Am Se Co. Open Office Furniture System, p. 22 (publication date unknown).
Transwall Movable Walls and Systems Furniture, Jul. 1995, p. 10 .
American Seating System, Jun. 1990.
Herman Miller Ethospace Installation Manual, May 1989.
Teknion, Jul. 1987.
Haworth, The Cygnia Collection List Prices, Jun. 11, 1985, pp. 19–22, 52–53.
Teknion Office Furniture Systems Price List, Apr. 1983, p. 33.
Unigroup By Haworth, 1982.
Unigroup by Haworth, Planning For Tomorrow, 1980, p. 10.
Sunar all Systems, PAS Price List, Apr. 1980, p. 19.
G.F. Business Equipment, Inc., Environmental Systems Program, 1973.

*Primary Examiner*—Carl D. Friedman
*Assistant Examiner*—Phi Dieu Tran A
*Attorney, Agent, or Firm*—Price, Heneveld, Cooper, DeWitt & Litton

[57] ABSTRACT

A partition construction includes a partition frame and a markerboard having a flat, dry erasable markerboard surface that erasably receives an erasable medium. The partition further includes top and bottom brackets for attaching the markerboard to the partition frame. The bottom bracket defines a bottom channel that receives a bottom edge of the markerboard. The top bracket defines an opposing top channel that engages a top edge of the markerboard. The top bracket includes an inner component attached to the partition frame and defining an inner portion of the top channel. The top bracket further includes an outer component that is attached to the inner component and defines an outer portion of the top channel. The outer component is configured to be secured after the markerboard is set on the bottom bracket and is pivoted into engagement with the inner components so that, when secured, the outer component, the inner component, and the bottom bracket capture the markerboard.

34 Claims, 13 Drawing Sheets

U.S. PATENT DOCUMENTS 3,998,018 12/1976 Hodges .
4,018,020 4/1977 Sauer et al. .
4,031,675 6/1977 Roberts et al. .
4,038,799 8/1977 Shanks .
4,103,981 8/1978 Donahue et al. .
4,123,879 11/1978 Blodee et al. .
4,128,979 12/1978 Price .
4,205,815 6/1980 Sauer et al. .
4,213,516 7/1980 Sulewsky .
4,224,769 9/1980 Ball et al. .
4,248,325 2/1981 Georgopoulos .
4,255,910 3/1981 Wendt .
4,263,764 4/1981 Wendt .
4,375,010 2/1983 Mollenkopf .
4,423,573 1/1984 Ombolt et al. .
4,535,577 8/1985 Tenser et al. .
4,631,881 12/1986 Charman .
4,665,662 5/1987 Swanborn .
4,685,255 8/1987 Kelley .
4,704,835 11/1987 Jordan .
4,771,583 9/1988 Ball et al. .
4,782,642 11/1988 Conville .
4,905,428 3/1990 Sykes .
4,995,605 2/1991 Conville .
5,038,539 8/1991 Kelley et al. .
5,056,577 10/1991 DeLong ..... 52/239
5,062,246 11/1991 Sykes .
5,175,969 1/1993 Knauf et al. .
5,301,484 4/1994 Jansson .
5,394,658 3/1995 Schreiner et al. .
5,400,560 3/1995 Hellwig et al. .
5,426,904 6/1995 Gilmore .
B1 4,876,835 6/1992 Kelly et al. .

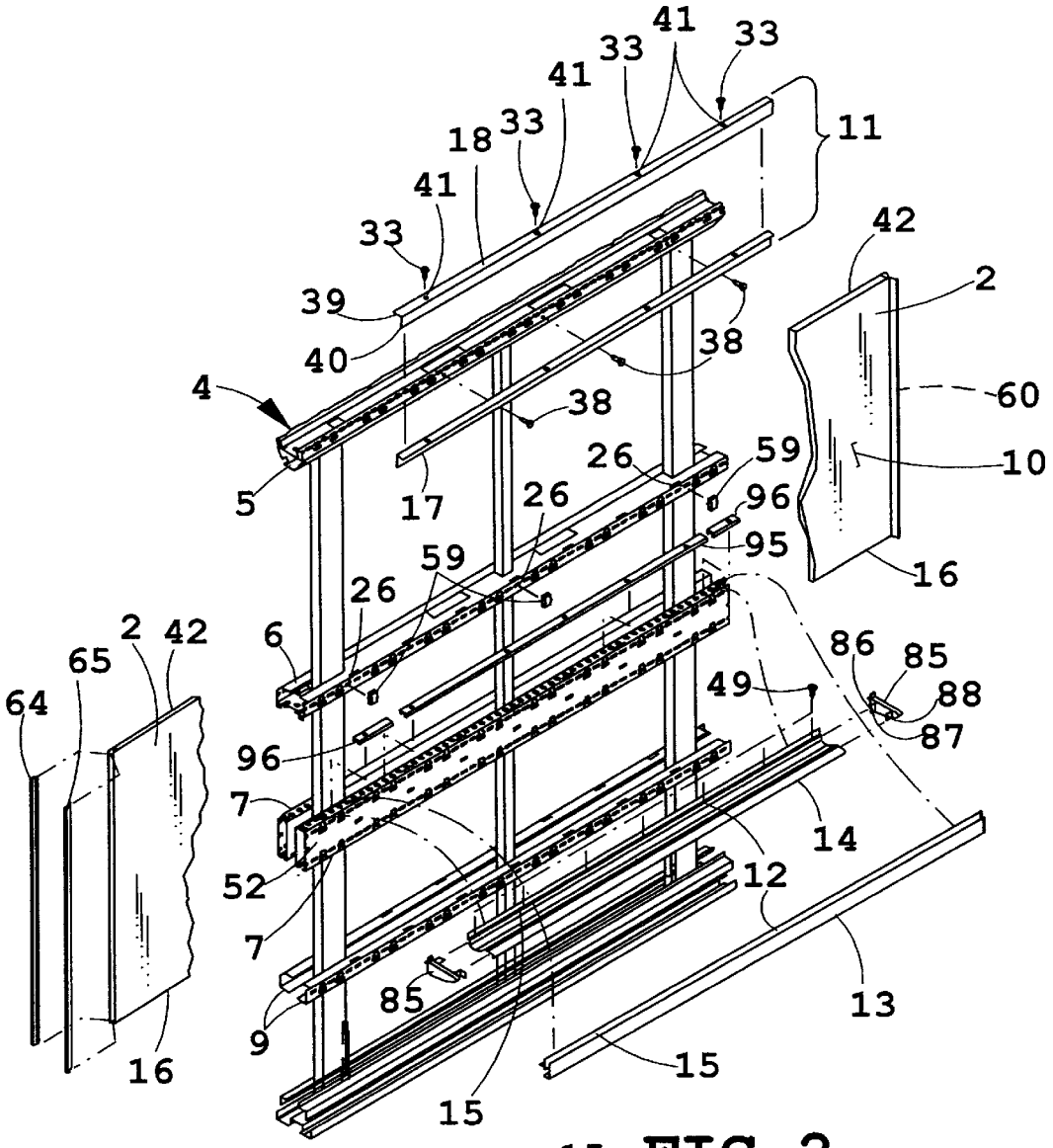
15 FIG. 2

PARTITION SYSTEM WITH ATTACHED MARKERBOARD

CROSS-REFERENCES TO RELATED PATENTS

The present application is related to U.S. Pat. No. 5,802,789, issued Sep. 8, 1998, entitled PARTITION CONSTRUCTION INCLUDING REMOVABLE COVER PANELS, the entire contents of which are incorporated herein by reference.

BACKGROUND OF THE INVENTION

The present invention relates to an office partition panel system that includes a markerboard construction that may be easily, yet securely attached to a panel frame.

Modern offices and work environments often include movable partition panels detachably interconnected to subdivide open spaces in a building into individual work stations and/or offices. Various markerboards have been used in conjunction with such partition panel systems. However, presently available markerboards are often difficult to attach to the partition panels, and may not provide a secure attachment, thereby resulting in misalignment, undesirable "looseness" and other functional and aesthetic problems. Markerboards that are installed over an existing decorative skin protrude outwardly from the partition panel and may have overall dimensions that prevent true integration of the markerboard into the partition panel system. In addition, markerboards that are not configured for attachment to a given partition panel system must be custom installed. The quality of this type of installation necessarily depends on the skill of the installer, and, therefore, may lead to inconsistent results in the appearance and structural integrity of the markerboard installation. Another problem associated with markerboards is the possibility that a user marking the board will inadvertently cause a marker to travel off an edge of the markerboard and onto an adjacent decorative cover panel, resulting in an unsightly and difficult to remove stain on the adjacent cover panel. Still further, existing markerboards may be installed in an unsecured manner that allows relatively easy removal without the use of tools, leading to unauthorized or unwanted tampering.

SUMMARY OF THE INVENTION

One aspect of the present invention is to provide a partition construction including a partition frame and a markerboard having an erasable markerboard surface. Top and bottom brackets defining opposing top and bottom channels are provided for attaching the markerboard to the partition frame. The top bracket includes an inner component attached to the partition frame and defining an inner portion of the top channel, and an outer component attached to the inner component for defining an outer portion of the top channel. The outer component is configured to be secured after the markerboard is set on the bottom bracket and is pivoted into engagement with the inner component so that, when secured, the outer component, the inner component, and the bottom bracket capture the markerboard.

These and other features, advantages and objects of the present invention will be further understood and appreciated by those skilled in the art by reference to the following specification, claims and appended drawings.

BRIEF DESCRIPTION OF THE DRAWINGS

FIG. 2 is an exploded, perspective view showing the partition frame and markerboard of FIG. 1;

DETAILED DESCRIPTION OF PREFERRED EMBODIMENT

Figure 1:
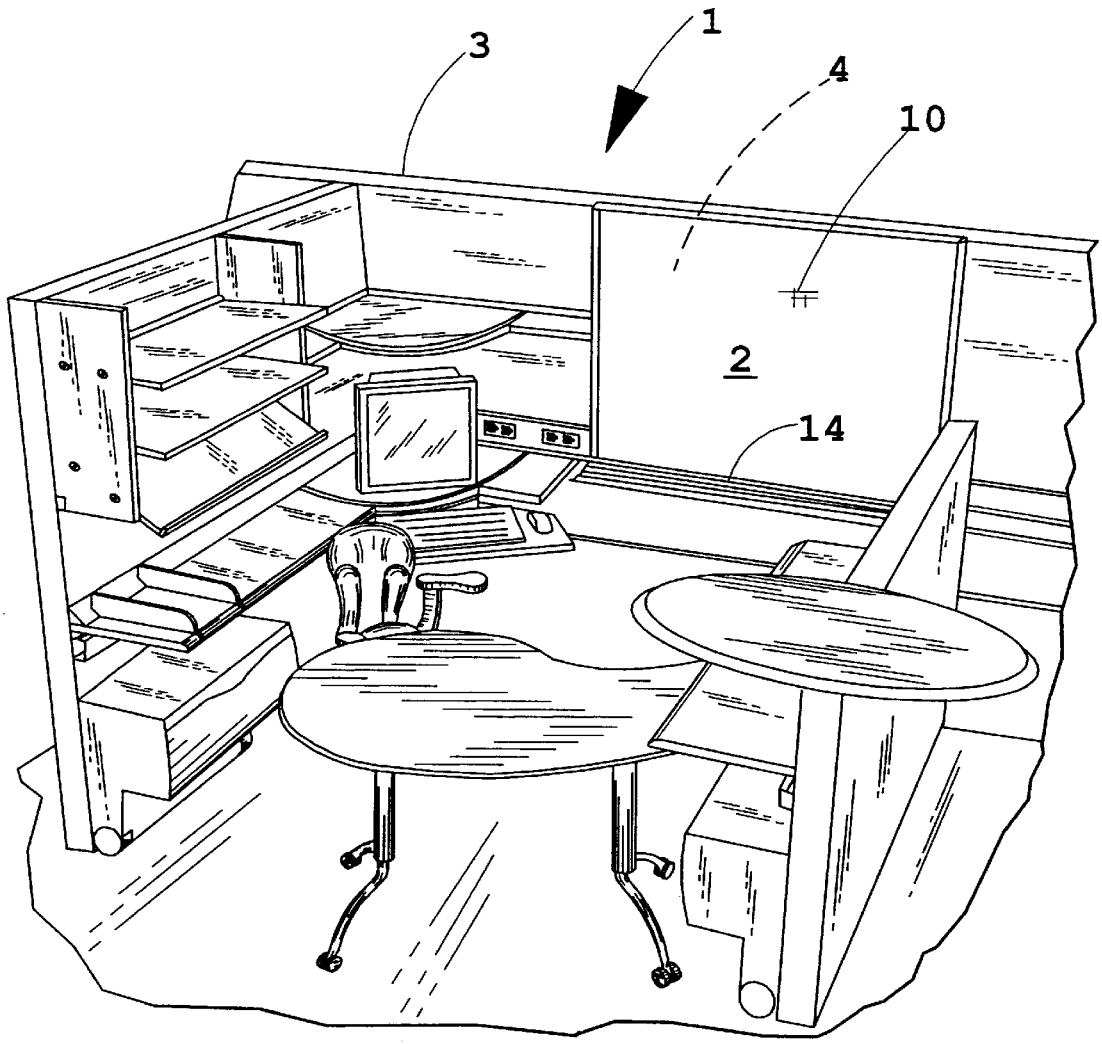
FIG. 1 is a perspective view of an office partition system including an erasable markerboard according to the present invention.
Figure 1A:
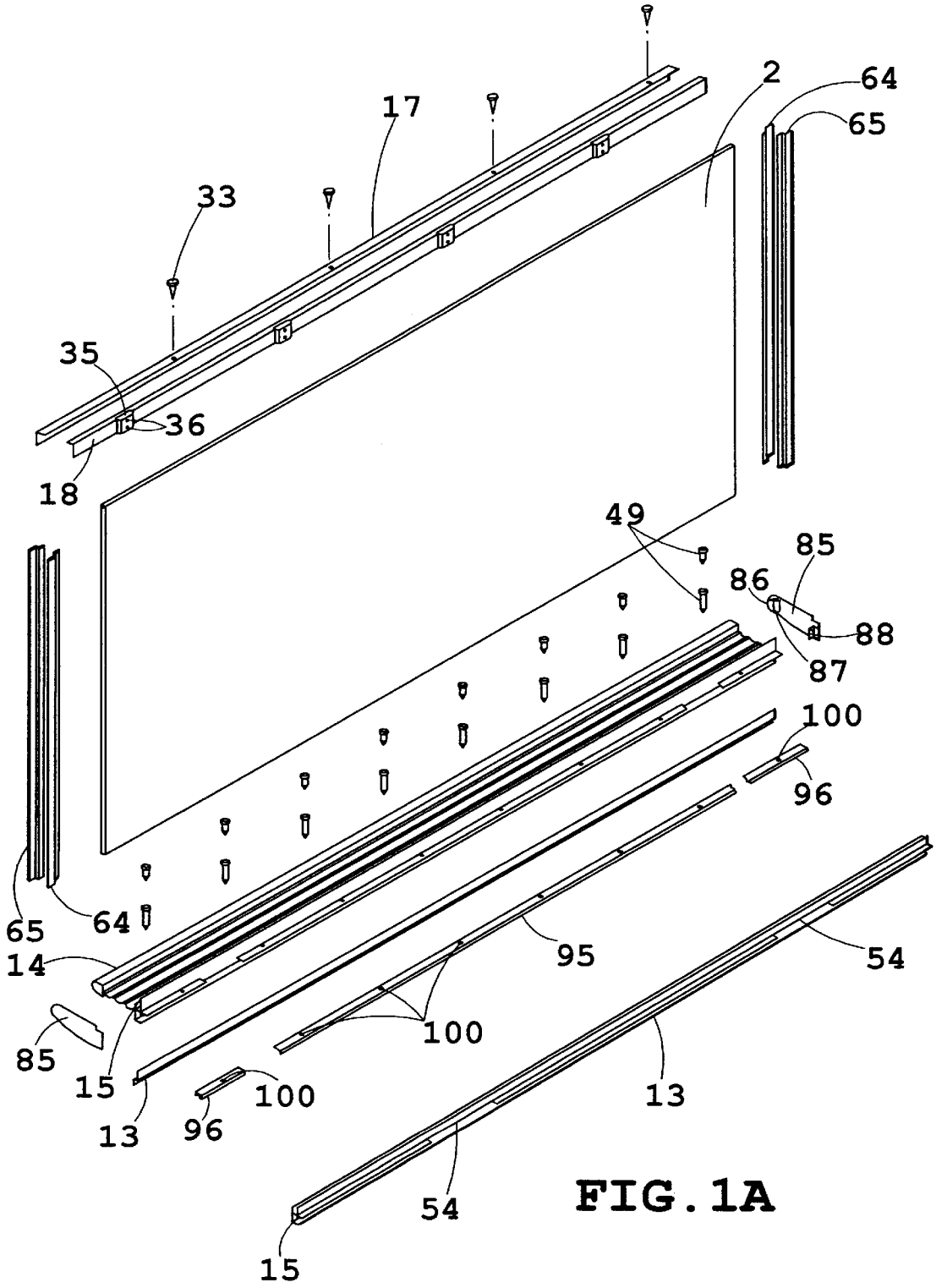
FIG. 1A is an exploded perspective view of the markerboard shown in FIG. 1.
Figure 2A:
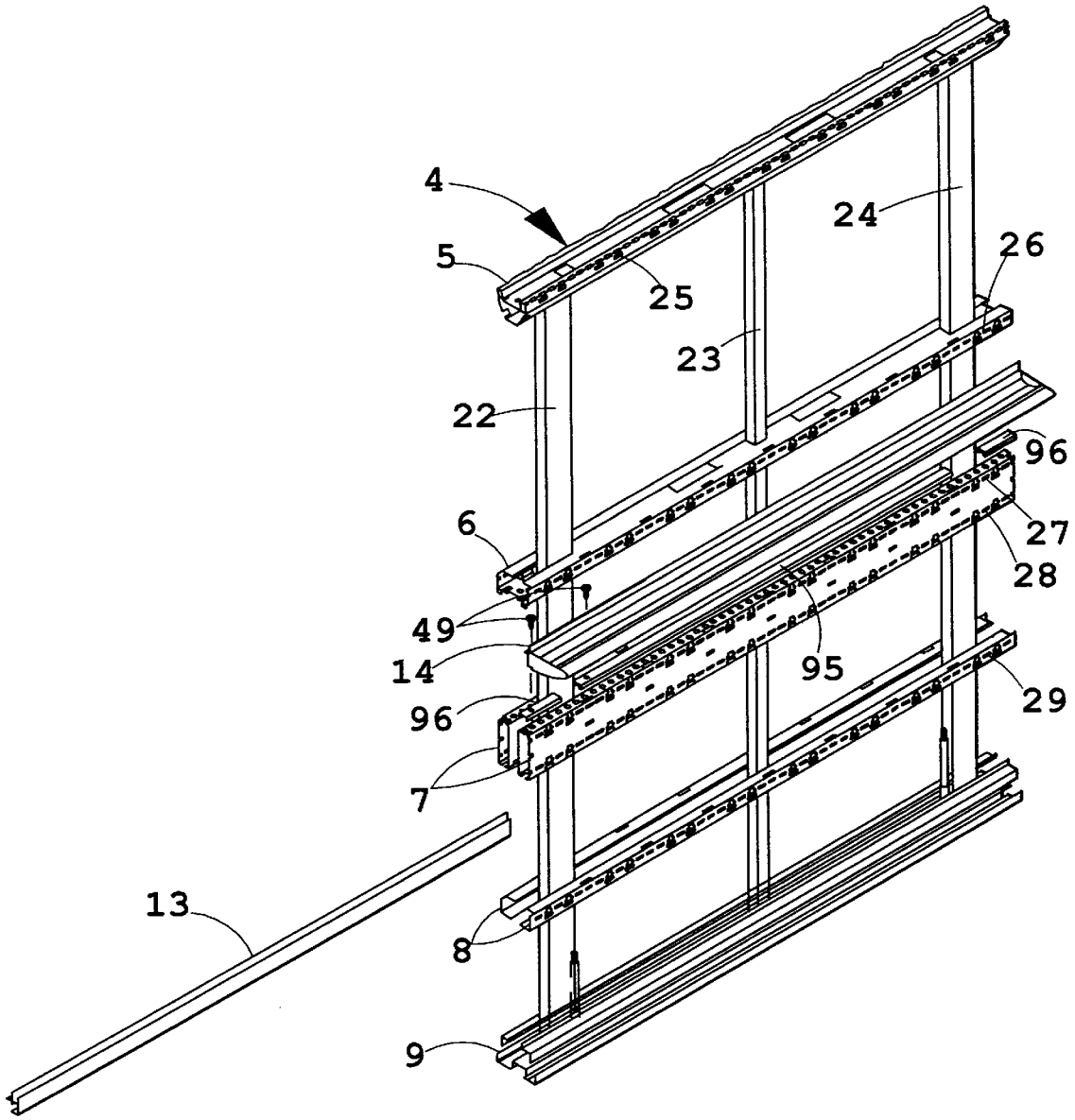
FIG. 2A is a partially exploded, perspective view of the partition frame of FIG. 2.
Figure 2B:
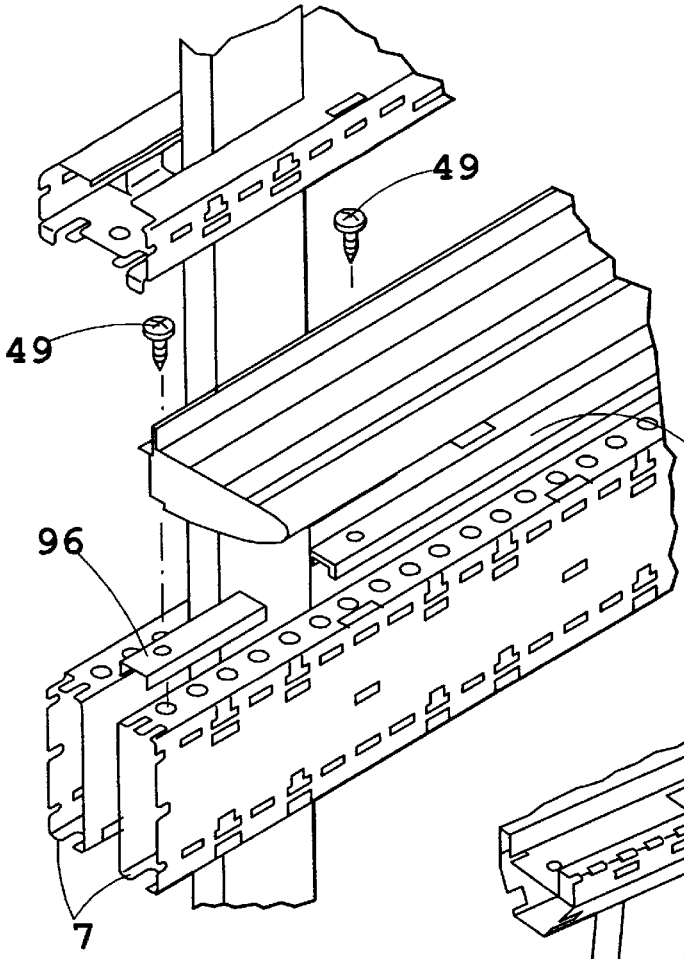
FIG. 2B is a fragmentary, perspective view showing a portion of the frame, spacers and tray of FIG. 2A.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A partition construction 1 (FIG. 1) embodying the present invention includes a markerboard construction 2 particularly designed for use in open office plans, and other similar settings and environments. The partition construction 1 includes a partition frame 4 supporting the markerboard 2 so that its flat surface faces outwardly and is flush with other cover panels on the partition construction 1. The outer surface of markerboard 2 is constructed to erasably receive an erasable medium 10. This type of surface is commonly known as a dry erasable markerboard, and preferably has a white color that is not easily stained such that marks may be readily erased by a user.

With reference to FIG. 2, the partition construction 1 includes a top bracket 11 and a bottom bracket 12 that attach the markerboard 2 to the partition frame 4. The bottom bracket 12 may be either a bottom rail 13, or a marker tray 14, each of which has a bottom channel 15 that faces upwardly to receive a bottom edge 16 of the markerboard 2. The top bracket 11 includes an inner component such as top rail 17 and an outer component such as top trim 18 that, when assembled, define a top channel 19 (FIG. 3) that opposes bottom channel 15. The top rail 17 defines an inner portion 20 of the top channel 19, and the top trim 18 defines an outer portion 21 of the top channel 19. The top trim 18 is configured to be secured after the markerboard 2 is set on the bottom bracket 12 and is pivoted into engagement with the top rail 17. When secured, the top trim 18, the top rail 17 and the bottom bracket 12 capture the markerboard 2.

As best seen in FIG. 2A, the partition frame 4 includes an upper horizontal frame member 5, an intermediate horizontal frame member 6, a pair of lower horizontal frame members 7, a pair of frame members 8 located at approximately knee height, and a base horizontal frame member 9 that is adapted to be secured to a building floor. The horizontal frame members are rigidly interconnected by horizontally spaced-apart upright frame members 22, 23 and 24. The horizontal frame members 5, 6 and 8 each have a horizontal row of discrete attachment locations such as slots 25, 26 and 29, respectively. Each of the lower horizontal frame members 7 includes an upper row of horizontal slots 27 and a lower row of horizontal slots 28. The frame construction details including the functional aspects of the horizontal rows of slots is described in more detail in U.S. Pat. No. 5,802,789, previously incorporated by reference.

With reference to FIGS. 5–8, the top rail 17 is made from sheet steel, and has a substantially L-shaped cross section with an upper horizontal leg 30 and an orthogonal lower, downwardly-extending vertical leg 31. A series of holes 32 in the leg 30 receive screws 33 (FIG. 3) to retain the top trim 18 to the top rail 17. The screws 33 preferably have a self-tapping configuration. The top rail 17 includes a series of bent-out wall portions 34 that are formed in the vertical leg 31. The bent-out wall portion 34 spaces the top rail 17 away from the upper horizontal frame member 5. A plate 37 fits into the depression formed by the bent-out portion 34, and provides additional strength adjacent the clearance hole 36 which receives a rivet 38 (FIG. 2) that secures the top rail 17 to the upper horizontal frame member 5. An opening 35 in the leg 30 provides clearance, and facilitates formation of the bent-out wall portion 34.

Figure 9:
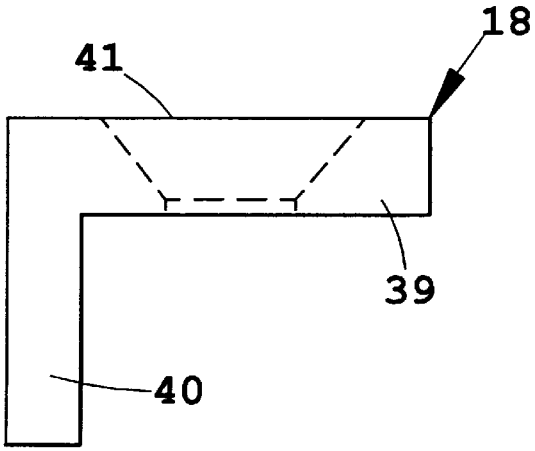
FIG. 9 is an end view of the top trim of FIG. 1A.

With reference to FIG. 9, the top trim 18 has a generally L-shaped cross section with an upper horizontal leg 39 and a lower vertical leg 40. The horizontal leg 39 includes a plurality of countersunk clearance holes 41 that receive screws 33 for connecting the top trim 18 to the top rail 17. When the top trim 18 is secured to the top rail 17, a generally U-shaped downwardly-opening top channel 19 is formed that receives and secures the top edge 42 of the markerboard 2.

Figure 10:
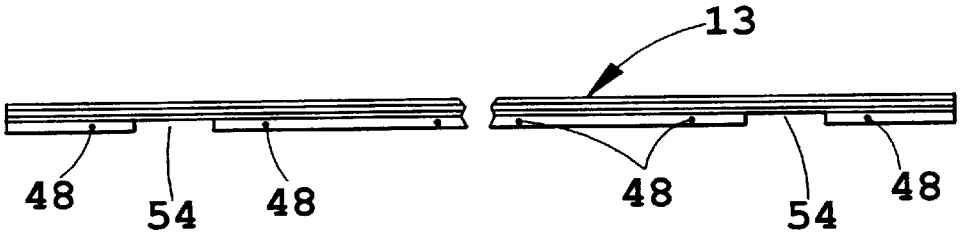
FIGS. 10 and 11 are fragmentary, top and front views of the bottom rail of FIG. 1A.
Figure 11:
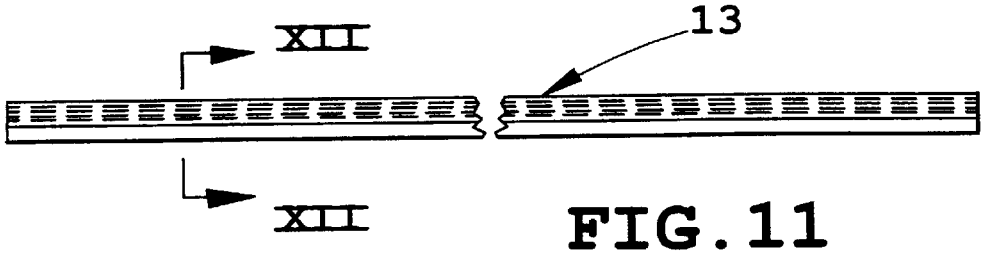
Figure 12:
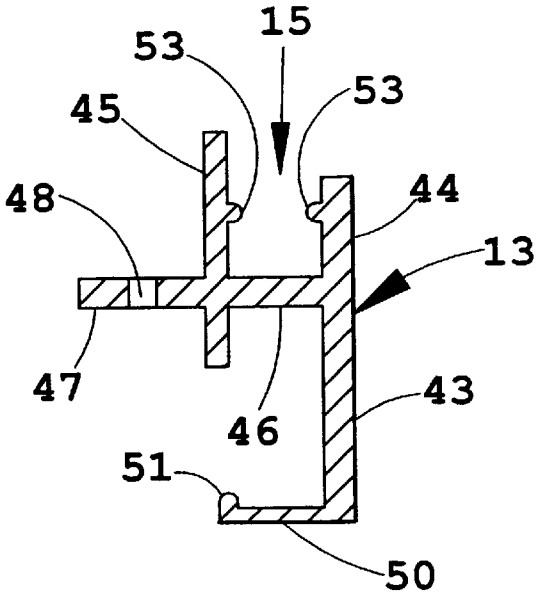
FIG. 12 is a cross-sectional view of the bottom channel taken along the line XII—XII of FIG. 11.
Figure 13:
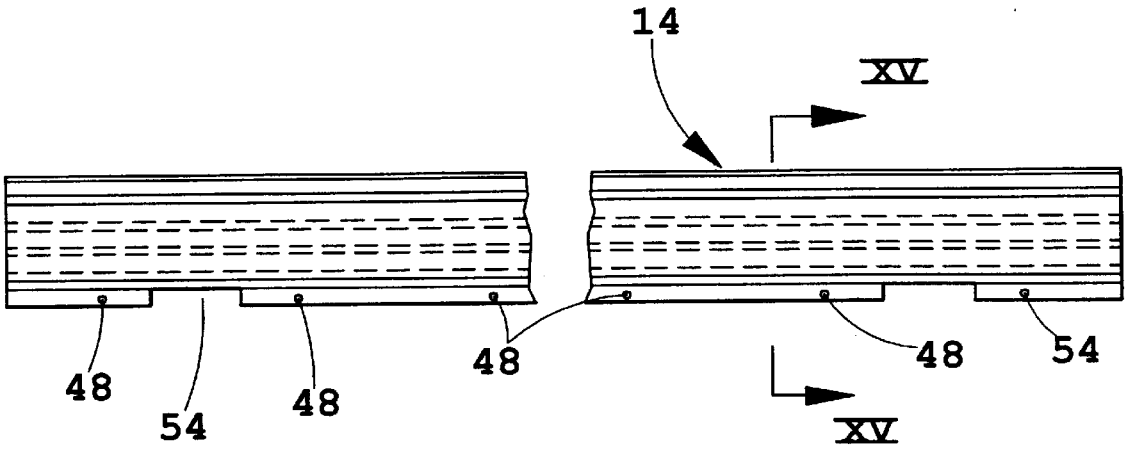
FIGS. 13 and 14 are fragmentary, top and elevational views of the tray of FIG. 1A.
Figure 14:
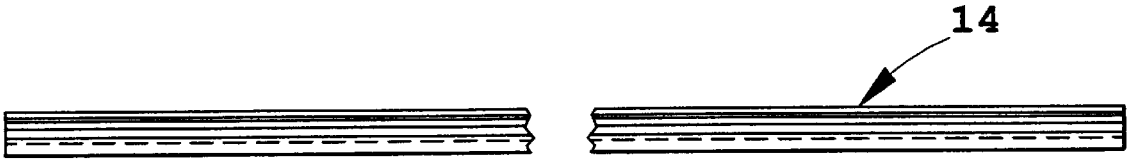
Figure 15:
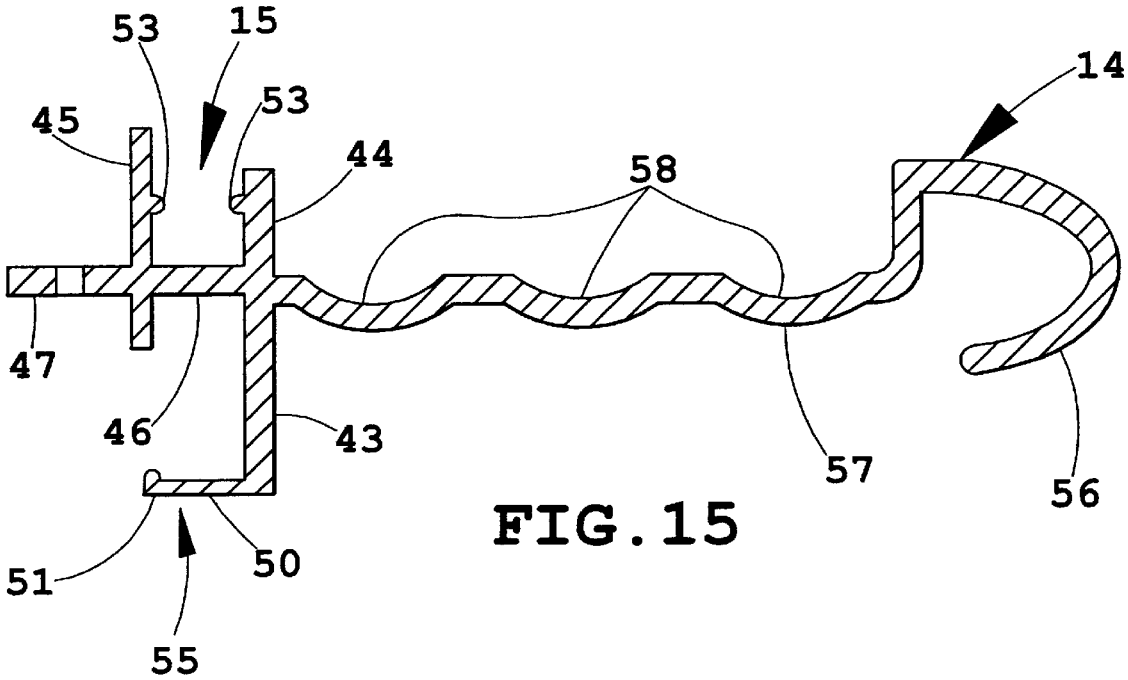
FIG. 15 is a cross-sectional view of the tray taken along the line XV—XV of FIG. 13.
Figure 18:
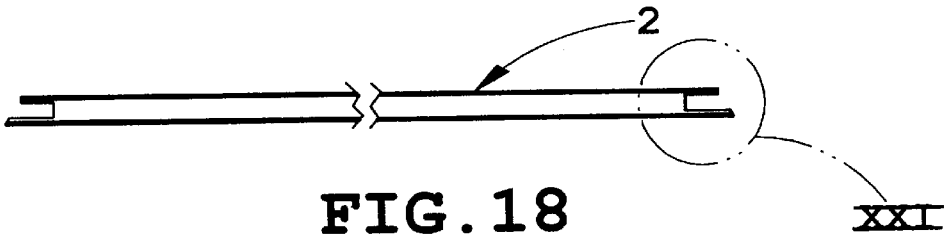
FIGS. 18, 19 and 20 are fragmentary, top, front and side views of the markerboard of FIG. 1.
Figure 19:
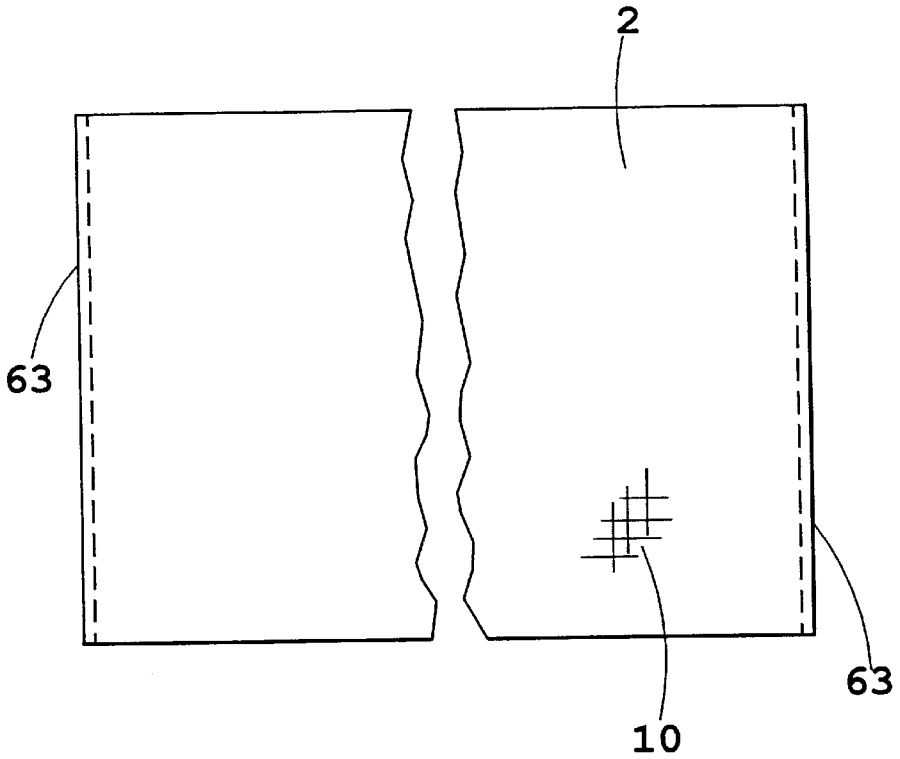
Figure 20:
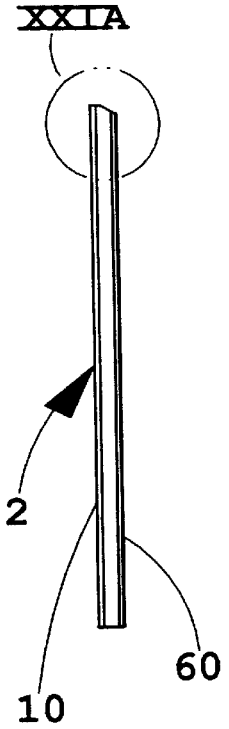

The bottom bracket 12 may comprise either a bottom rail 13 (FIGS. 10–12), or a marker tray 14 (FIGS. 13–15). The bottom rail 13 is made of extruded aluminum, and includes a front wall 43 that extends upwardly to form a forward lip 44. A horizontal wall 46 extends rearwardly to form a rear support flange 47 having a plurality of clearance holes 48 that receive screws 49 (FIG. 4) to secure the bottom rail 13 to the lower horizontal frame member 7. A brace 50 extends rearwardly from a lower edge of the front wall 43, and terminates at an edge 51 that abuts a front surface 52 (FIG. 2) of the lower horizontal frame member 7 such that downward forces due to the markerboard 2 resting in the channel 15 are substantially reacted by the couple between the screws 49 and the contact between the brace 50 and the horizontal frame member 7. Markerboard 2 abuts a pair of opposing ridges 53 in the bottom channel 15 thereby providing a relatively snug fit between the markerboard 2 and the bottom rail 13 that also allows the bottom edge 16 of the markerboard 2 to pivot during installation of the markerboard 2. Cut-outs 54 in the rear support flange 47 provide clearance for the upright frame members 22, 23 and 24.

Figure 4:
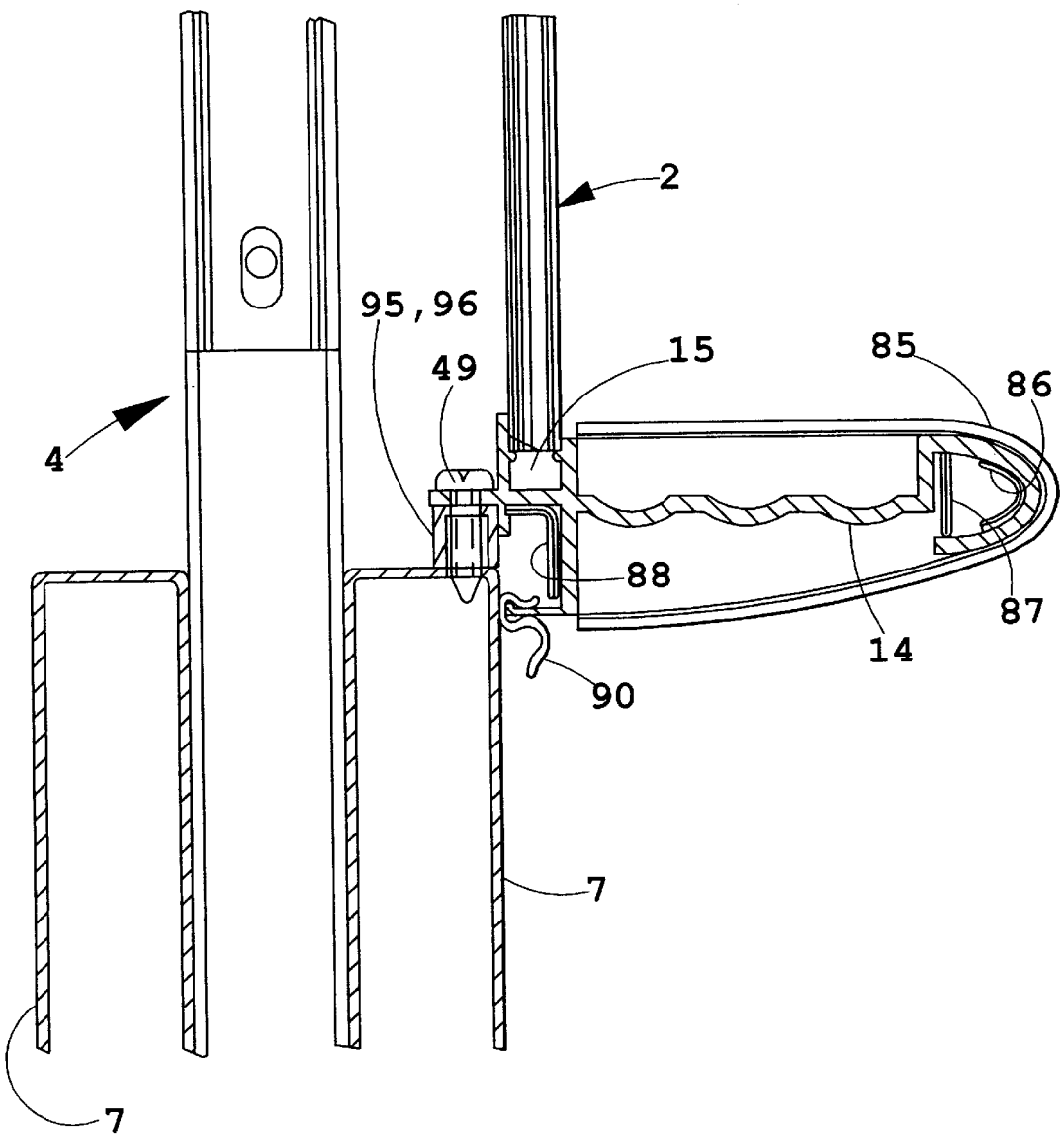
FIG. 4 is a fragmentary, cross-sectional view of the partition frame and bottom bracket of FIG. 1.
Figure 5:
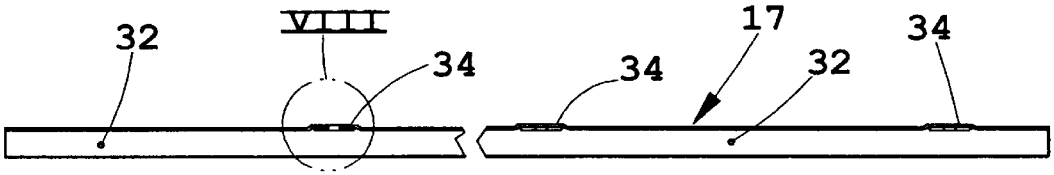
FIGS. 5 and 6 are fragmentary, top and side elevational views of the top rail of FIG. 1A.
Figure 6:
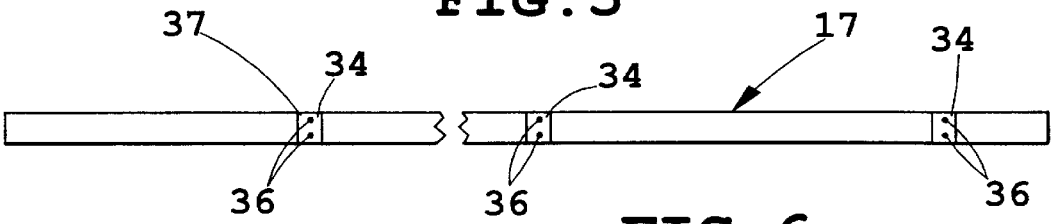
Figure 7:
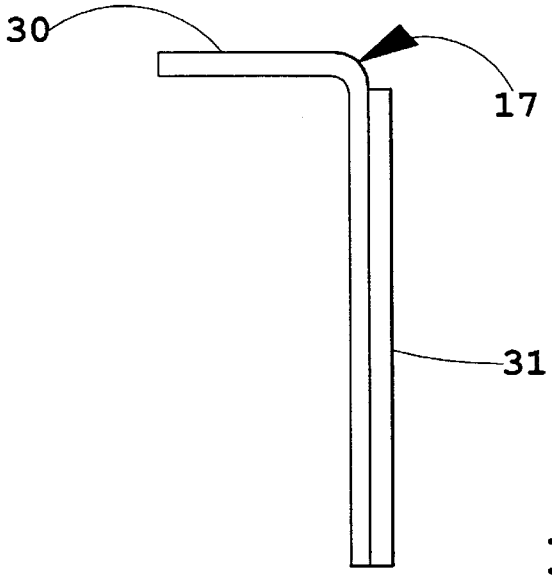
FIG. 7 is an end view of the top rail of FIG. 1A.
Figure 8:
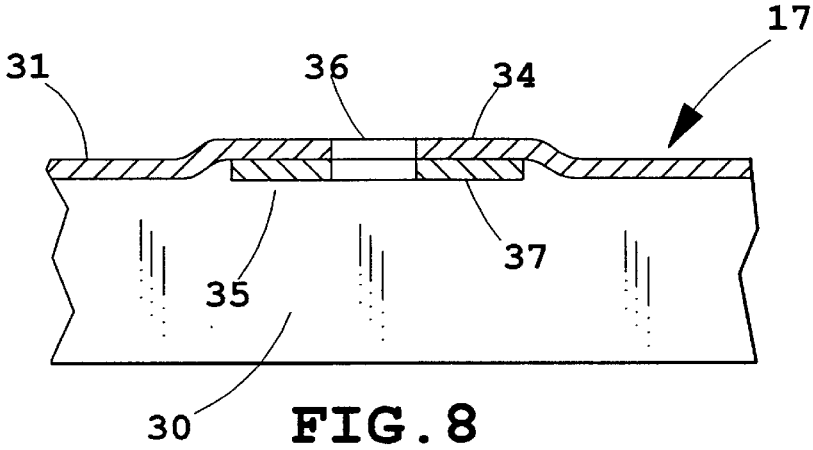
FIG. 8 is an enlarged fragmentary view of a circled portion VIII of the top rail of FIG. 5.

With reference to FIGS. 13–15, a marker tray 14 may be used at the bottom edge of the markerboard 2 rather than the bottom rail 13 if desired for a particular application. The base portion 55 of the marker tray 14 has substantially the same cross-sectional shape as the bottom rail 13 described above. However, tray marker 14 further includes a tray portion 57 that extends outwardly from the base portion 55. The tray portion 57 includes two or three arcuate portions 58 that extend along the length of the marker tray 14. The tray portion 57 terminates in a curved front edge 56. Clearance holes 48 in the rear support flange 47 are used to secure the marker tray 14 in the same manner as described above for the bottom rail 13. Cut-out portions 54 in the rear support flange 47 provide clearance for the frame uprights as described above with respect to the bottom rail 13. As best seen in FIGS. 2 and 4, end caps 85 are adhesively bonded to marker tray 14. End caps 85 are made of a polymeric material, and include protrusions 86, 87 and 88 that engage the ends of the marker tray 14.

Figure 16:
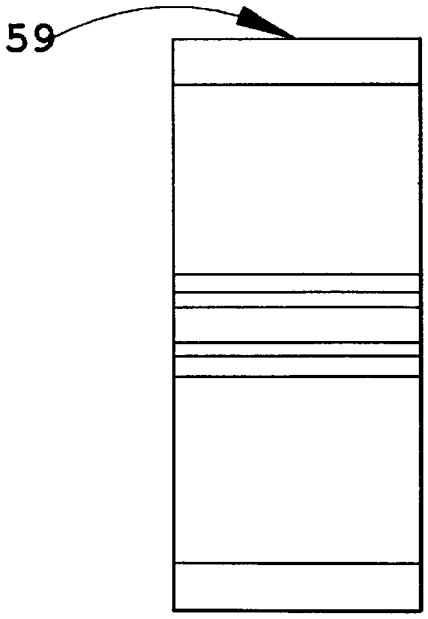
FIGS. 16 and 17 are front and side views of the bumper of FIG. 2.
Figure 17:
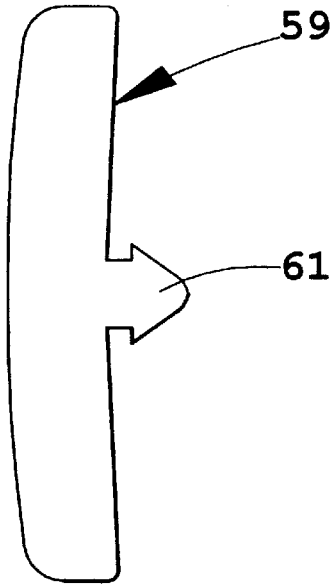

With reference to FIG. 2, polyester foam pads 59 are adhered over or adjusted to, slots 26 of the horizontal frame member 6, and contact the inner surface 60 of the markerboard 2 to provide additional support therefore, and to provide dampening so that the whiteboard does not rattle when it is being written on. Pad 59 may have a substantially flat face that is bonded to the horizontal frame members, or, pad 59 may include a barbed stem 61 that is received in a selected one of the slots 26 (FIGS. 16, 17).

Figure 23:
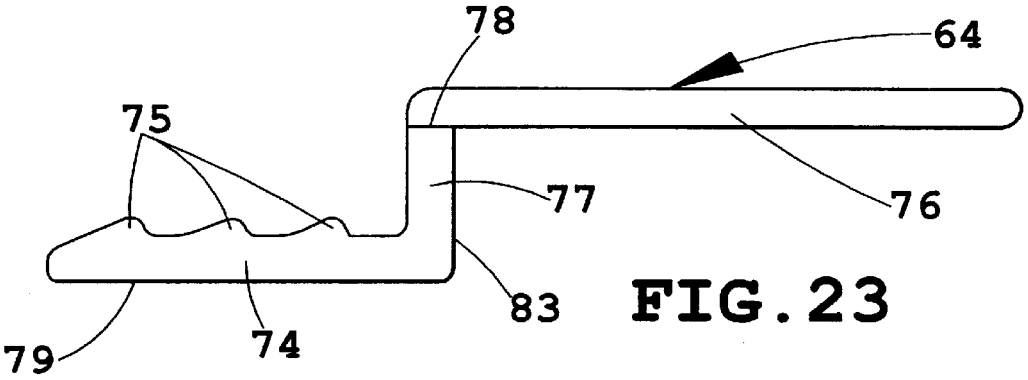
FIG. 23 is an enlarged end view of the vertical seal of FIG. 2.
Figure 22:
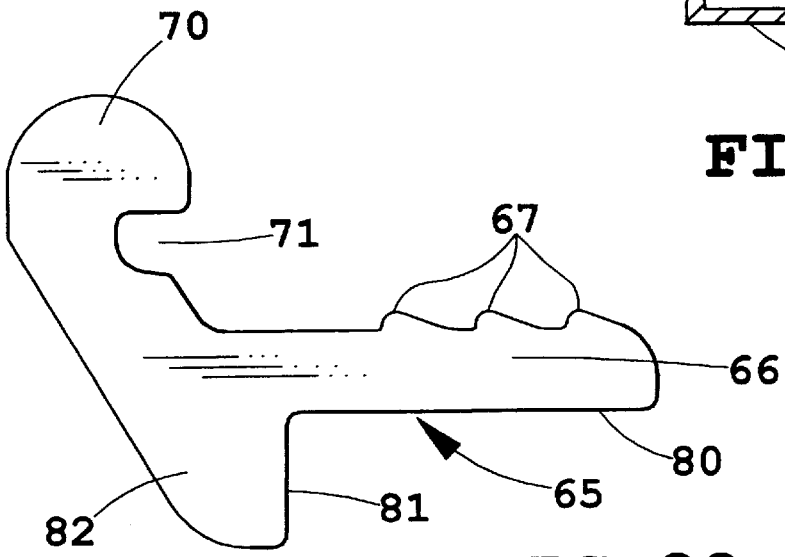
FIG. 22 is an enlarged end view of the vertical trim strip of FIG. 2.
Figure 21:
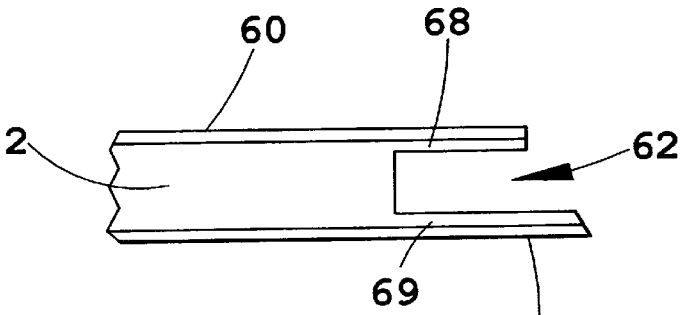
FIG. 21 is a fragmentary end view of the circled edge XXI of the markerboard of FIG. 18.
Figure 21A:
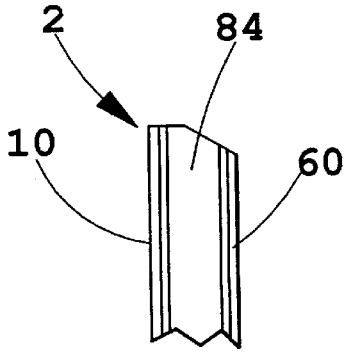
FIG. 21A is a fragmentary view of the top circled edge XXIA of the markerboard of FIG. 20.
Figure 24:
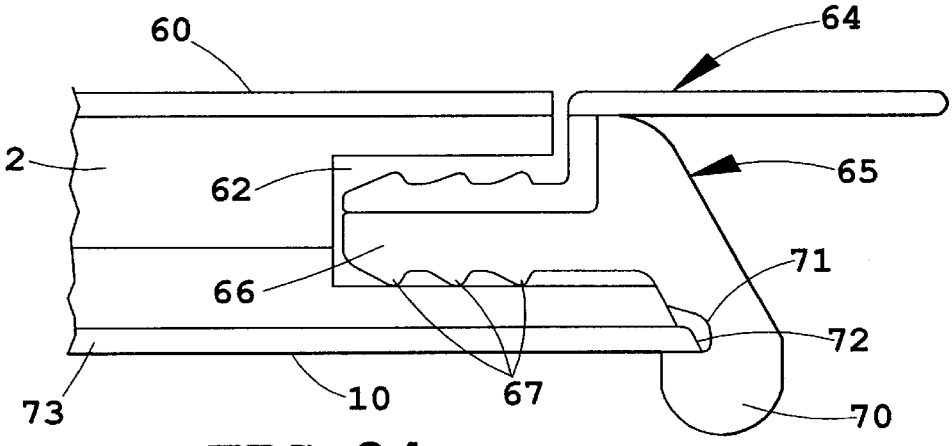
FIG. 24 is an end view of the vertical seal and the vertical trim installed into the cavity along the side edge of the markerboard of FIG. 21.

With reference to FIGS. 18–21A, the markerboard 2 has a flat, dry erasable markerboard front surface 10, and a sidewardly-opening U-shaped cavity 62 formed by parallel front and rear walls 69 and 68, respectively, extending along each side edge 63. With further reference to FIGS. 22, 23 and 24, an elongated vertical seal 64 and an elongated aluminum vertical trim 65 are removably received within the cavity 62 of the markerboard 2. The trim strip 65 includes an attachment leg portion 66 with three ridges or barbs 67 that extend along the attachment leg portion 66. The vertical trim strip 65 also includes a lip 70 that extends outwardly from the front surface 10 of the markerboard and prevents a user from inadvertently slidingly moving a marker from the markerboard to the adjacent panel surface. A groove 71 adjacent the base of the lip 70 receives the side edge 72 of the surface layer 73 of the markerboard 2 (FIG. 24). With reference to FIG. 21A, the core 84 is a light density wood fiber board or other suitable material that is sandwiched between a marker laminate, such as WILSONART marker laminate, on both sides.

With reference to FIGS. 23 and 24, the vertical seal 64 is a co-extruded, dual durometer part that includes an attachment leg portion 74 with a plurality of ridges 75 extending along the attachment leg 74. A rear flange 76 is parallel to leg 74 and offset rearwardly therefrom by attachment leg 74 by web 77. The attachment leg portion 74 and web 77 are made of a substantially rigid polyvinyl chloride ("PVC") material having a durometer of 80 plus or minus 3D per ASTMD 2240-75, and the rear flange portion 76 is made of a relatively flexible PVC material having a durometer of 88 plus or minus 5A per ASTMD 2240-75, with the line 78 generally designating the border between the flexible and rigid portions of the vertical seal 64. When the vertical seal and trim 64, 65 are installed into the cavity 62, the side surfaces 79 and 80 of the attachment leg portions 66, 76 respectively, of the seal and trim strip 64 and 65 respectively, abut one another, and the rear surface 81 of the rear lip 82 of the trim strip 65 abuts the forward surface 83 of the web 77 of the seal 64. The thickness of the attachment leg portions 66 and 76 are chosen to provide an interference fit within cavity 62 such that the seal and trim strips 64 and 65 are securely yet removably retained.

Figure 25:
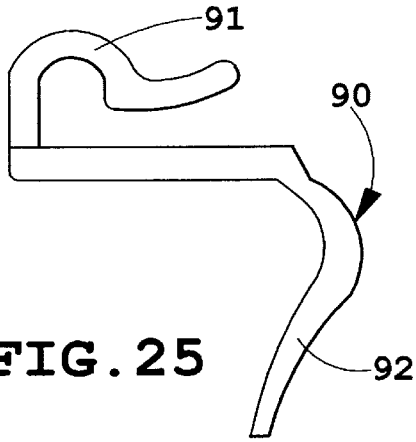
FIG. 25 is an end view of the horizontal seal strip of FIG. 2.

With reference to FIG. 25, a horizontal seal 90 is made of a polymeric material and includes a relatively rigid clip portion 91 that clips over the rearwardly-extending brace 50 of a bottom rail 13 or marker tray 14. The horizontal seal strip 90 also includes a downwardly-extending flexible flange 92 that extends over the lower horizontal slot 28 in the horizontal frame member 7, thereby providing a light block while still allowing access to the lower slots 28 for mounting of accessory units.

Figure 2C:
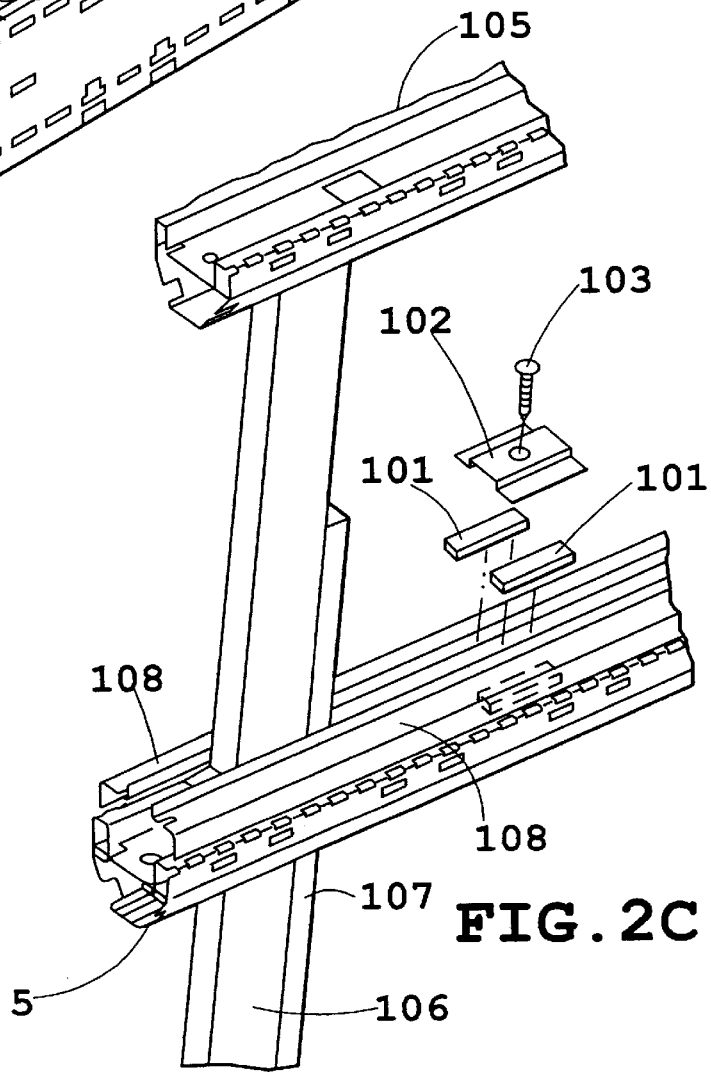
FIG. 2C is a fragmentary, perspective view showing the spacers and stabilizing brackets used with a stacking frame section.
Figure 3:
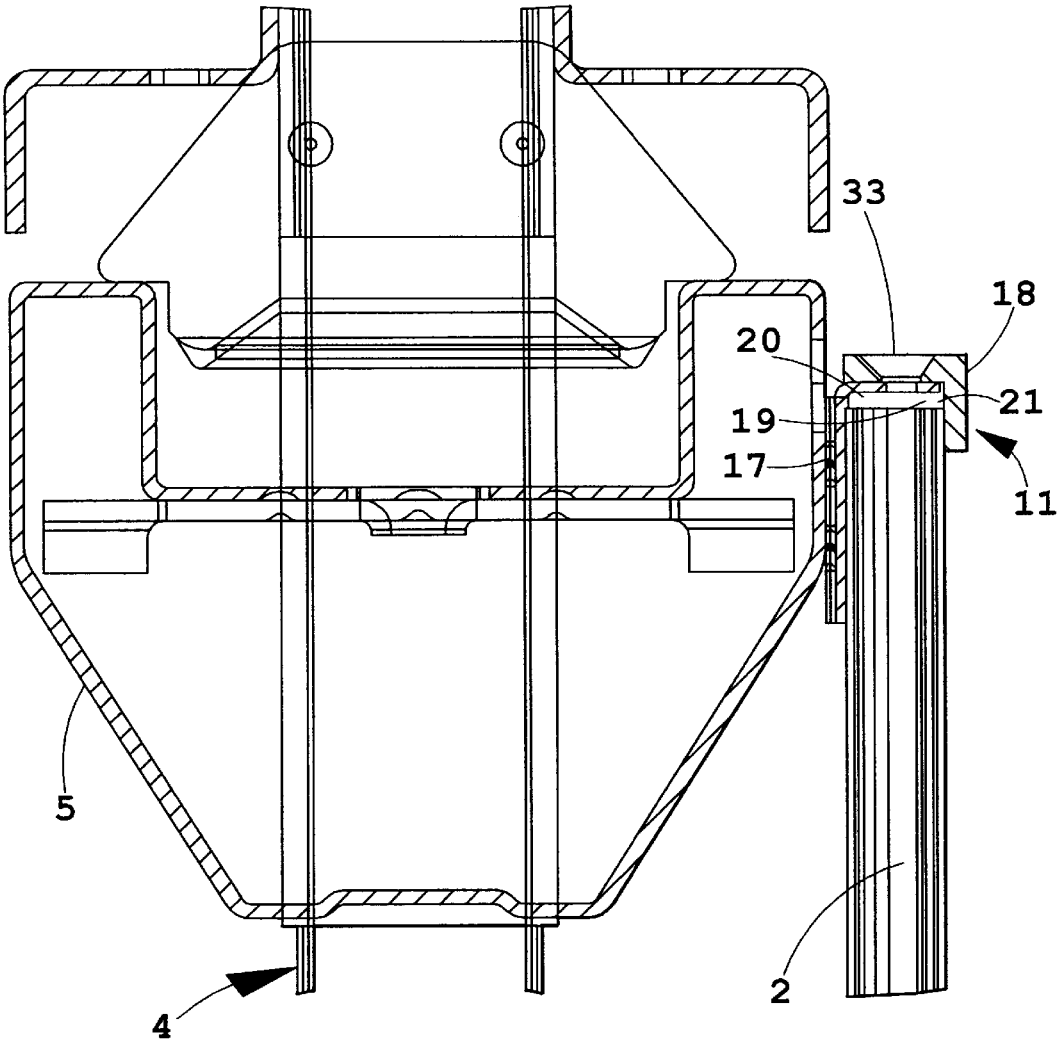
FIG. 3 is a fragmentary, cross-sectional view of the partition frame and top bracket of FIG. 1.
Figure 26:
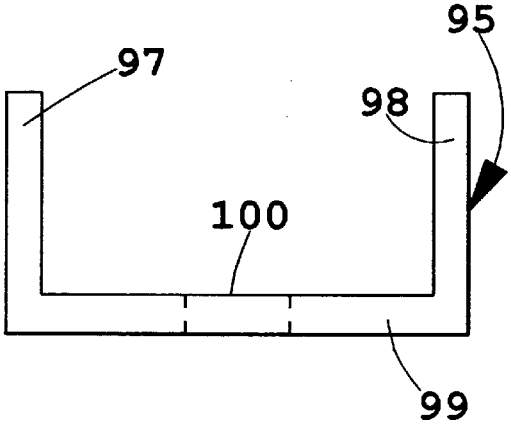
FIG. 26 is an end view of the U-shaped spacer of FIG. 1A.
Figure 27:
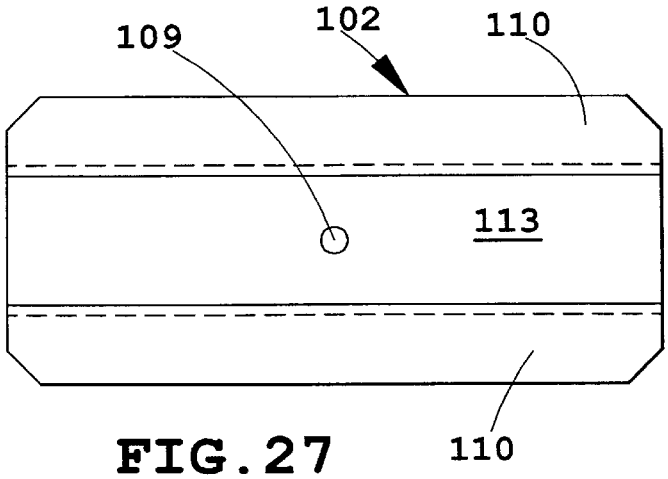
FIGS. 27 and 28 are top and side views of the stacker bracket of FIG. 2C.
Figure 28:
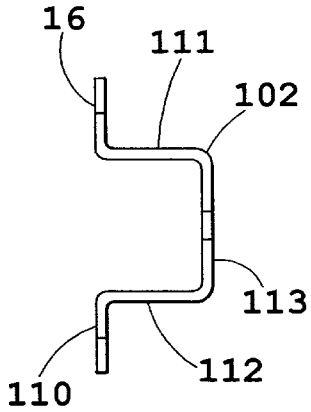

With reference to FIG. 2, a U-shaped center spacer 95 and end spacers 96 having the same cross-sectional shape fit below the rear support flange 47 of the bottom rail 13 or marker tray 14. The spacers 95 and 96 are formed from aluminum, and have a web 99 with legs 97 and 98 that form a U-shaped cross-sectional area as shown in FIG. 26. Clearance holes 100 are provided for the mounting screws 49. As described in the above-referenced U.S. Pat. No. 5,802,789 relating to the partition frame 4, a stacker frame 105 (FIG. 2C) may be mounted to a lower frame 106 by an elongated tubular vertical attachment member 107. The stacker frame 105 has a pair of horizontal base members 108 that extend along the upper side of the upper horizontal frame member 5 such that a stacker stabilizing bracket 102 and stacker spacers 101 are required to connect the bottom bracket 12 or bottom rail 13 when the markerboard is installed to a partition frame 4 that includes a stacker frame 105. As illustrated in FIGS. 27 and 28, the stacker bracket 102 is formed from sheet metal and has a generally hat-shaped cross-sectional area with a web 113, legs 111 and 112, and a pair of flanges 110. Screw 103 is received in the clearance hole 109 to fasten the bracket 102 to the horizontal frame member 5.

To install the markerboard 2 on the partition frame 4, the spacers 95 and 96 are first placed on the horizontal frame member 7. The horizontal seal strip 90 is then clipped onto the brace 50 of the bottom rail 13 or marker tray 14, and the bottom rail 13 or marker tray 14 is fastened to the horizontal frame member 7 using screws 33. The top rail 17 is then secured to the upper horizontal frame member 5 using rivets 38. The seal 64 and trim strip 65 are then inserted into the cavity 62 along the side edges of the markerboard 2. The lower edge 16 of the markerboard 2 is placed into the bottom channel 15, and the upper edge 42 of the markerboard is rotated inwardly towards the partition frame 4 until the rear side 60 of the markerboard 2 comes into contact with the top rail 17. The top trim 18 is then fastened to the top rail 17 by means of screws 33, thereby securely capturing the markerboard 2 to the partition frame 4.

When installed, the markerboard 2 is securely integrated into the panel system in a manner that cannot be easily removed without tools, while simultaneously providing an aesthetically pleasing integrated appearance. In addition, the top rail 17 and bottom rail 13 or marker tray 14 prevent a decorative panel skin from being inadvertently interchanged with a markerboard panel section. The markerboard surface 10 is substantially flush with the adjacent decorative panel skins for optimal appearance, and the lip 70 of vertical trim strip 65 prevents inadvertent marking of adjacent decorative skins.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

1. A partition construction, comprising:

a partition frame;

a markerboard including a flat surface constructed to erasably receive an erasable medium; and top and bottom brackets attaching the markerboard to the partition frame, the bottom bracket defining a bottom channel rotatably receiving a bottom edge of the markerboard, the top bracket defining an opposing top channel engaging a top edge of the markerboard, the top bracket including a discrete inner component attached to the partition frame and defining a discrete inner portion of the top channel adapted to receive the top edge of the markerboard during installation, and including a discrete outer component attached to the inner component and defining an outer portion of the top channel adapted to secure the top edge during installation, the discrete outer component being configured to be secured to the inner component after the markerboard is set on the bottom bracket and is pivoted into engagement with the inner component so that, when secured, the discrete outer component, the discrete inner component, and the bottom bracket capture the markerboard.

2. The partition construction defined in claim 1, wherein the outer component of the top channel comprises a top trim strip with an L-shaped cross section, the L-shaped cross section defining a pair of legs that are generally orthogonally disposed to one another and oriented with a first leg extending horizontally and a second leg extending downwardly therefrom when the top trim strip is in an installed position.

3. The partition construction defined in claim 2, wherein the inner component of the top channel comprises a top rail with an L-shaped cross section defining a pair of legs that are orthogonally disposed to one another and oriented with a first leg extending horizontally and a second leg extending downwardly therefrom when the top trim strip is in an installed position.

4. The partition construction defined in claim 3, wherein the bottom channel includes an upwardly-opening U-shaped cross-sectional portion defining an opening that receives a bottom edge of the markerboard for support thereof, said U-shaped cross-sectional portion including a wider portion adjacent said opening that permits pivoting of said markerboard about said bottom edge thereof when said bottom edge is received in said U-shaped portion, said U-shaped portion further including a narrow portion that abuttingly supports said markerboard upon movement of said markerboard into a vertical, installed position to thereby securely position said markerboard in the installed position.

5. The partition construction defined in claim 4, wherein the bottom channel includes a rearwardly-extending support flange with apertures therethrough; and the partition further includes fasteners received through the apertures and rigidly connecting the bottom channel to the partition frame.

6. The partition construction defined in claim 5, wherein the bottom channel includes a rearwardly-extending brace spaced-apart and below the support flange terminating in a free edge that abuts the partition frame such that the support flange and brace in combination form a rigid, moment-resisting connection of the bottom channel to the partition frame.

7. The partition construction defined in claim 6, wherein the partition frame includes upper and lower vertically spaced-apart horizontal frame members that are rigidly interconnected to at least two horizontally spaced-apart vertical frame members to form a rigid, generally quadrilateral frame section; and wherein the partition frame further includes a spacer located between the lower horizontal frame member and the support flange and supports the bottom channel at an upwardly-spaced location from the lower horizontal frame member.

8. The partition construction defined in claim 7, wherein the upper and lower horizontal frame members each include a horizontal row of evenly-spaced discrete attachment locations.

9. The partition construction defined in claim 8, wherein the evenly-spaced discrete attachment locations comprise slots in each of the horizontal frame members.

10. The partition construction defined in claim 9, wherein each side edge of the markerboard includes a lip that extends outwardly in a perpendicular manner to prevent a user marking the markerboard with a marker from inadvertently running the marker off a side edge of the markerboard.

11. The partition construction defined in claim 10, wherein the flat, erasable surface of the markerboard is white.

12. A partition construction, comprising:

a partition frame;

a markerboard including an erasable flat surface constructed to erasably receive an erasable medium;

top and bottom brackets attaching the markerboard to the partition frame, the bottom bracket defining a bottom channel receiving a bottom edge of the markerboard, the top bracket defining an opposing top channel engaging a top edge of the markerboard, the top bracket including an inner component attached to the partition frame and defining an inner portion of the top channel adapted to receive the top edge of the markerboard during installation, and including an outer component attached to the inner component and defining an outer portion of the top channel adapted to secure the top edge during installation, the outer component being configured to be secured to the inner component after the markerboard is set on the bottom bracket and is pivoted into engagement with the inner component so that, when secured, the outer component, the inner component, and the bottom bracket capture the markerboard;

said outer component of the top channel comprising a top trim strip with an L-shaped cross section, the L-shaped cross section defining a pair of legs that are generally orthogonally disposed to one another and oriented with a first leg extending horizontally and a second leg extending downwardly therefrom when the top trim strip is in an installed position;

said inner component of the top channel comprising a top rail with an L-shaped cross section defining a pair of legs that are orthogonally disposed to one another and oriented with a first leg extending horizontally and a second leg extending downwardly therefrom when the top trim strip is in an installed position;

said bottom channel including an upwardly-opening U-shaped cross-sectional portion that receives a bottom edge of the markerboard for support thereof;

said bottom channel including a rearwardly-extending support flange with apertures therethrough;

said bottom channel including a rearwardly-extending brace spaced-apart and below the support flange terminating in a free edge that abuts the partition frame such that the support flange and brace in combination form a rigid, moment-resisting connection of the bottom channel to the partition frame;

said partition further including fasteners received through the apertures and rigidly connecting the bottom channel to the partition frame;

said partition frame including upper and lower vertically spaced-apart horizontal frame members that are rigidly interconnected to at least two horizontally spaced-apart vertical frame members to form a rigid, generally quadrilateral frame section;

said partition frame further including a spacer located between the lower horizontal frame member and the support flange and supporting the bottom channel at an upwardly-spaced location from the lower horizontal frame member;

said upper and lower horizontal frame members each including a horizontal row of evenly-spaced slots in each of the horizontal frame members;

each side edge of the markerboard including a lip that extends outwardly in a perpendicular manner to prevent a user marking the markerboard with a marker from inadvertently running the marker off a side edge of the markerboard;

each side edge of the markerboard including a sidewardly-opening U-shaped cavity defined by parallel front and rear walls, the U-shaped cavity extending vertically along substantially the entire side edge of the markerboard; and wherein the outwardly-extending lip is defined by a vertically elongated first trim strip that includes an attachment leg portion that is closely yet removably received within the U-shaped cavity to retain the trim strip to the side edge of the markerboard.

13. The partition construction defined in claim 12, wherein the partition further includes a second vertically elongated trim strip having an attachment leg portion and a rear flange portion that is offset rearwardly from the attachment leg portion and substantially parallel thereto, the attachment leg portion of the second trim strip abutting the attachment leg portion of the first trim strip within the U-shaped cavity such that the first and second trim strips are each closely yet removably received within the U-shaped cavity.

14. The partition construction defined in claim 13, wherein the first trim strip is extruded aluminum and the second trim strip is a polymeric material.

15. The partition construction defined in claim 14, wherein the polymeric material forming the attachment leg of the second trim strip is substantially softer than the polymeric material forming the rear flange.

16. The partition construction defined in claim 1, wherein the partition frame includes upper and lower vertically spaced-apart horizontal frame members that are rigidly interconnected to at least two horizontally spaced-apart vertical frame members to form a rigid, generally quadrilateral frame section; and wherein the partition frame further includes a spacer located between the lower horizontal frame member and the support flange, the spacer supporting the bottom channel at an upwardly-spaced location from the lower horizontal frame member.

17. The partition construction defined in claim 16, wherein the upper and lower horizontal frame members each include a horizontal row of evenly-spaced discrete attachment locations.

18. The partition construction defined in claim 17, wherein the discrete attachment locations comprise slots in each of the horizontal frame members.

19. The partition construction defined in claim 1, wherein each side edge of the markerboard includes a lip that extends outwardly in a perpendicular manner to prevent a user marking the markerboard with a marker from inadvertently sliding a marker off a side edge of the markerboard onto an adjacent decorative panel surface.

20. A partition construction, comprising:

a partition frame having a pair of vertically spaced-apart horizontal frame members, each of the horizontal frame members including a horizontal row of discrete attachment locations configured to removably support hang-on accessory units for horizontal adjustment; and a markerboard construction including top and bottom brackets and a markerboard panel with a flat surface for receiving a dry erasable marker substance, the markerboard panel being secured to selected ones of the discrete attachment locations on the partition frame by the top and bottom brackets.

21. The partition construction defined in claim 20, wherein the horizontal row of discrete attachment locations comprise slots.

22. The partition construction defined in claim 21, wherein each of the slots are evenly spaced-apart.

23. The partition construction defined in claim 22, wherein the bottom bracket defines a bottom channel receiving a bottom edge of the markerboard and the top bracket defines an opposing top channel engaging a top edge of the markerboard.

24. The partition construction defined in claim 23, wherein the top bracket includes an inner component attached to the partition frame and defining an inner portion of the top channel, the top bracket further including an outer component attached to the inner component and defining an outer portion of the top channel, the outer component being configured to be secured after the markerboard is set on the bottom bracket and is pivoted into engagement with the inner component so that, when secured, the outer component, the inner component, and the bottom bracket capture the markerboard.

25. The partition construction defined in claim 24, wherein the outer component of the top channel comprises a top trim strip with an L-shaped cross section defining a pair of legs that are orthogonally disposed to one another and oriented with a first leg extending horizontally and a second leg extending downwardly therefrom when the top trim strip is in an installed position.

26. The partition construction defined in claim 25, wherein the inner component of the top channel comprises a top rail with an L-shaped cross section defining a pair of legs that are orthogonally disposed to one another and oriented with a first leg extending horizontally and a second leg extending downwardly therefrom when the top trim strip is in an installed position.

27. The partition construction defined in claim 26, wherein the bottom channel includes an upwardly-opening U-shaped cross-sectional portion that receives a bottom edge of the markerboard for support thereof.

28. The partition construction defined in claim 27, wherein the bottom channel includes a rearwardly-extending support flange with apertures therethrough; and the partition further includes fasteners received through the apertures and rigidly connecting the bottom channel to the partition frame.

29. The partition construction defined in claim 20, wherein each side edge of the markerboard includes a lip that extends outwardly in a perpendicular manner to prevent a user marking the markerboard with a marker from inadvertently running the marker off a side edge of the markerboard.

30. The partition construction defined in claim 29, wherein each side edge of the markerboard includes a sidewardly-opening U-shaped cavity defined by parallel front and rear walls, the U-shaped cavity extending vertically along substantially the entire side edge of the markerboard, and wherein the outwardly-extending lip is defined by a vertically elongated first trim strip that includes an attachment leg portion that is closely yet removably received within the U-shaped cavity to retain the trim strip to the side edge of the markerboard.

31. The partition construction defined in claim 30, wherein the partition further includes a second vertically elongated trim strip having an attachment leg portion and a rear flange portion that is offset rearwardly from the attachment leg portion and substantially parallel thereto, the attachment leg portion of the second trim strip abutting the attachment leg portion of the first trim strip within the U-shaped cavity such that the first and second trim strips are each closely yet removably received within the U-shaped cavity.

32. The partition construction defined in claim 31, wherein the first trim strip is extruded aluminum and the second trim strip is a polymeric material.

33. A method of assembling a markerboard to a partition frame, comprising:

securing an elongated horizontal upper rail to the partition frame;

securing an elongated horizontal lower channel to the partition frame at a location that is spaced-apart below the upper rail;

placing a lower edge of the markerboard in the lower channel;

rotating the lower edge of the markerboard within the lower channel, thereby moving an upper edge of the markerboard towards the partition frame until the top edge of the markerboard abuts the upper rail; and securing the upper edge of the markerboard to the partition frame.

34. A method of assembling a markerboard to a partition frame, comprising:

securing an elongated horizontal upper rail to the partition frame;

securing an elongated horizontal lower channel to the partition frame at a location that is spaced-apart below the upper rail;

placing a lower edge of the markerboard in the lower channel;

rotating an upper edge of the markerboard towards the partition frame until the top edge of the markerboard abuts the upper rail; and securing the upper edge of the markerboard to the partition frame;

securing the upper edge of the markerboard to the partition frame including fastening a horizontal trim strip to the partition frame with a portion of the horizontal trim strip abutting a front surface of the markerboard.

* * * * *

UNITED STATES PATENT AND TRADEMARK OFFICE

CERTIFICATE OF CORRECTION

PATENT NO. : 5,906,079
DATED : May 25, 1999
INVENTOR(S) : Brinkner et al.

It is certified that error appears in the above-identified patent and that said Letters Patent is hereby corrected as shown below:

Title page, item [73],

Assignee:

"Steelcase, Inc." should be --Steelcase Inc.--.

Signed and Sealed this

Fifteenth Day of February, 2000

*Attest:*

Q. TODD DICKINSON

*Attesting Officer*

*Commissioner of Patents and Trademarks*